US005370187A

United States Patent [19]

Ferguson et al.

[11] Patent Number: 5,370,187

[45] Date of Patent: Dec. 6, 1994

[54] OVER-PRESSURED WELL FRACTURING METHOD

[75] Inventors: Keith R. Ferguson; Joseph H. Schmidt, both of Anchorage, Ak.

[73] Assignee: Atlantic Richfield Company, Los Angeles, Calif.

[21] Appl. No.: 126,945

[22] Filed: Sep. 24, 1993

[51] Int. Cl.[5] ..... E21B 43/26

[52] U.S. Cl. ..... 166/308; 166/313

[58] Field of Search ..... 166/308, 313, 271, 52

[56] References Cited

U.S. PATENT DOCUMENTS 2,875,833 3/1959 Martin ..... 166/52 X
4,501,326 2/1985 Edmunds ..... 166/271 X
5,131,472 7/1992 Dees et al. ..... 166/308
5,271,465 12/1993 Schmidt et al. ..... 166/308 X

*Primary Examiner*—William P. Neuder
*Attorney, Agent, or Firm*—Michael E. Martin

[57] ABSTRACT

Hydraulic fractures are initiated or extended into earth formations from a first well by filling a space within the wellbore and a tubing string extending within the well with a fracturing fluid, placing the first well in fluid flow communication with a tubing string extending within a second well and increasing the pressure of fluid in the respective tubing strings sufficient to initiate or extend the fracture. The second well serves as an accumulator for accumulating a sufficient charge of pressure fluid, such as gas, to drive the fracturing fluid in the first well into the formation to a suitable extent.

10 Claims, 1 Drawing Sheet

OVER-PRESSURED WELL FRACTURING METHOD

BACKGROUND OF THE INVENTION

1. Field of the Invention

The present invention pertains to a method for hydraulically fracturing an earth formation from a wellbore by over-pressuring the wellbore with a pressure drive fluid and using one or more nearby wells in communication with the wellbore to be fractured to act as accummulators for the pressure drive fluid.

2. Background

U.S. patent application Ser. No. 07/874,159, filed Apr. 27, 1992 in the name of Joseph H. Schmidt, et al and assigned to the assignee of the present invention, is incorporated herein by reference. The Schmidt, et al patent application describes improved methods for over-pressuring a well to initiate or extend hydraulic fractures into an earth formation in communication with the well at a sustained flow rate to provide a near wellbore fracture which will not pinch off, in the near wellbore region, in a subsequent conventional hydraulic fracturing operation. The fracturing methods described in the Schmidt, et al patent application include the steps of providing a charge of compressed gas for urging fracturing fluid into the formation upon perforation of the well casing or upon release of the fracturing fluid to flow into the formation from a tubing string closed by a frangible closure member.

The methods described in the Schmidt, et al patent application, as well as the methods described in the prior art of record in the Schmidt, et al patent application, are, however, limited in their effectiveness by the amount of pressure gas charge that may be used to force the fracturing fluid into the formation during the fracture treatment. In this regard, there has been a recognized need to provide additional gas charge at the fracture or breakdown pressure to assure sufficient driving force for the fracturing fluid that is actually forced into the formation and which may include at least some of the gas charge itself. Further in this regard, pressure vessels full of pressure gas may be placed in communication with the well to be fractured. However, there are certain disadvantages to using pressure vessels charged with the pressure driving fluid. Since the fluid pressures required for the fracture treatment are usually relatively high any vessels charged with gas at the required pressures pose additional hazards to operating personnel and structure at or near the wellhead.

Still further, in certain well installations, such as on offshore platforms and the like, there is usually inadequate space for placing the pressure vessels or accummulators which might be used to supplement the pressure fluid charge used to effect the fracturing operation. However, in accordance with the present invention, a unique method has been developed for providing an accumulator for additional fluid charge available for driving the fracturing fluid into the formation to initiate or extend a suitable well fracture, which method is described in further detail hereinbelow.

SUMMARY OF THE INVENTION

The present invention provides a unique method for initiating or extending fractures in an earth formation through a well by forcing a hydraulic fracturing fluid into the formation at or above formation breakdown pressure and at a sustained flow rate provided by one or more accumulator wells which are placed in communication with the well to be fractured and which hold a charge of drive fluid at or above the pressure of the drive fluid charge in the well being fractured.

In accordance with an important aspect of the present invention, a charge of compressed gas is provided in a well conduit which is in communication with the wellbore region from which the fracture is to be extended and additional gas charge is built up in one or more wells adjacent to or capable of being placed in fluid flow communication with the well being fractured to provide additional drive fluid for driving fracturing fluid into the formation to be fractured. Accordingly, one or more "accumulator" vessels are provided by utilizing the volume of a nearby wellbore or a tubing string disposed in a nearby wellbore. In this way, additional drive fluid capacity is made available for use in the fracture initiation and extension without the requirement of providing pressure vessels at the surface and adjacent to the well being fractured. Accordingly, the costs and hazards associated with providing pressure vessels for pressure fluids used to initiate and extend a fracture from a wellbore using a so-called over-pressured method are eliminated or minimized by utilizing the fluid receiving and holding space of one or more wells which are near the well to be fractured and which may be easily placed in fluid flow communication with the well to be fractured.

Those skilled in the art will recognize the above-described features and advantages of the present invention together with other superior aspects thereof upon reading the detailed description which follows in conjunction with the drawing.

DESCRIPTION OF PREFERRED EMBODIMENTS

Figure 1:
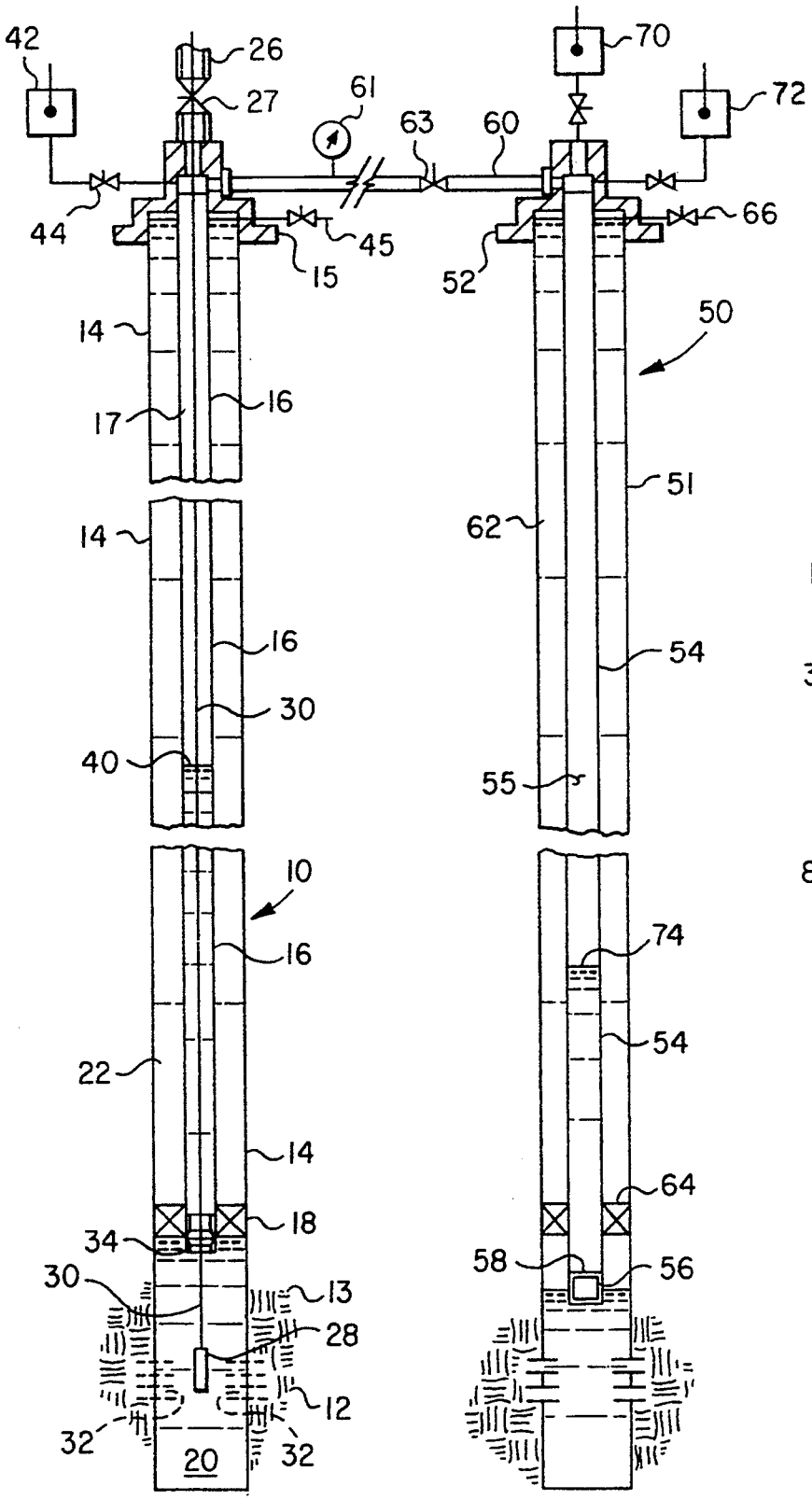
FIG. 1 is a schematic diagram of a well to be fractured in accordance with the method of the invention and showing a drive fluid accumulator well in conjunction therewith.

Referring to FIG. 1, there is illustrated a well 10 which extends into an earth formation 12 and is provided with a conventional casing 14, wellhead 15 and a tubing string 16 extending within the casing from the wellhead to a point adjacent a zone of interest 13 in the formation from which fluids are desired to be produced, for example. The formation zone of interest 13 lies generally below a conventional packer 18 which serves to pack off a space 20 in the casing 14 from an annular space 22 between the tubing string 16 and the casing 14.

The wellhead 15 is adapted to include a suitable wireline lubricator assembly 26 mounted thereon in a conventional manner and capable of being isolated from the interior of the tubing string 16 by a suitable wireline valve 27. In the arrangement illustrated in FIG. 1, the well 10 has been configured to prepare for perforation of the casing 14 and subsequent fracturing of the earth formation in the zone 13. In this regard, a conventional casing perforating tool or gun 28 is disposed in the space 20 and suspended from a conventional electric line 30. The gun 28 is operable to perforate the casing 14 to provide perforations or ports 32 into the formation zone 13. The tubing string 16 is also provided with a suitable landing nipple 34 at the lower distal end thereof whereby, if the perforations 32 already exist, an alternate embodiment of the method of the invention may be carried out as will be explained in further detail herein.

In the condition of the well 10 illustrated, the space 20 and the tubing string 16 are filled with a suitable fracturing liquid up to a level indicated by numeral 40. Liquid may be introduced into the space 20 and the tubing string 16 by way of a pump 42 in communication with the wellhead 15 by way of a shutoff valve 44 or the liquid level 40 may be achieved by the methods described in U.S. patent application Ser. No. 07/874,159. The annular space 22 is also operable to be in communication with a source of pressure fluid, not shown, by way of a conduit 45.

In many oil and gas well installations and similar wells used for the production or injection of fluids with respect to a subterranean earth formation, other wells are in proximity to the well in question. For example, in offshore oil and gas well platforms several wells are drilled from a relatively small space such as the deck of the platform and the wellheads are located relatively close to each other. In other well installations including those on land, wells are sufficiently close together to enable one to practice the method of the present invention.

FIG. 1 also illustrates a second well 50 which may be a fluid production or injection well and includes a conventional casing 51 and wellhead 52. A tubing string 54 extends within the casing 51 and may terminate in a suitable landing nipple 56 in which a conventional closure plug 58 may be retrievably disposed, as illustrated. Accordingly, the tubing string 54 provides a suitable space 55 for the containment of pressure fluid for use in accordance with the method of the present invention.

In the diagram of FIG. 1, the wells 10 and 50 are in communication with each other by way of a suitable high-pressure conduit 60 interconnecting the wellheads 15 and 52 in such a way that the interior of the tubing string 16 is in communication with the interior of the tubing string 54 as defined by the space 55. A suitable shutoff valve 63 may be interposed in the conduit 60 and is normally open during operation of the method described herein. The well 50 also includes a suitable annulus 62 defined by the casing 51 and the tubing string 54 and delimited by a conventional packer 64, for example. The space 62 may be filled with pressure fluid by way of a conduit 66 in communication with the annulus through the wellhead 52. Pressure gas may be introduced into the interior 55 of the tubing string 54, the space 17 and the conduit 60 by way of a compressor 70 in communication with the wellhead 52, for example. The compressor 70 may also be connected directly to the conduit 60 or the wellhead 15 for pressurizing the space 55, the conduit 60 and the interior space 17 of the conduit 16. Liquid may be introduced into the interior of the conduit 54 by way of a pump 72 operable to be in communication with the wellhead 52 so as to reduce the amount of space in the interior of the tubing string 54 occupied by gas as a method of compressing the gas in the space 55, the conduit 60 and the space 17 to a predetermined pressure. FIG. 1 shows a quantity of liquid 74 disposed in the lower portion of the tubing string 54 as indicated.

Although only one "accumulator" well 50 is illustrated connected to the well 10 by way of a pressure fluid flow conduit 60, those skilled in the art will recognize that several accumulator wells such as the well 50 may be placed in flow communication with the tubing string 16 in accordance with the method of the invention. The well 50 may be a well which is temporarily taken out of fluid production by placing the plug 58 at the lower end of the tubing string 54 or, if the tubing string 54 is not capable of standing the predetermined pressure desired to be built up therein, it may be replaced by a so-called workstring or a tubing string having suitably strong conduit to withstand the fluid pressures exerted thereon. Alternatively, or in addition to providing a tubing string of suitable pressure rating, the annular space 62 may be filled with liquid and pressurized to a predetermined pressure to reduce the differential pressure acting on the tubing string 54. In like manner, the annulus 22 of the well 10 may also be filled with pressure fluid to reduce the pressure differential acting on the tubing string 16 when it is pressurized in accordance with the invention.

Figure 2:
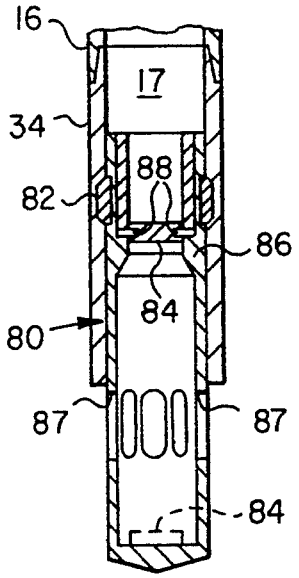
FIG. 2 is a section view of a shear disk and support body for use in connection with the method of the present invention.

As mentioned previously, the perforations 32 may already exist when it is desired to initiate or extend a fracture in the formation zone 13. In this regard, the perforating gun 28 and electric line 30 would not be disposed in the well 10, but fluid pressure may be built up in the space 17 by placing a frangible member in the landing nipple 34 such as illustrated in FIG. 2. In FIG. 2, a so-called shear disk assembly 80 is shown disposed in the landing nipple 34 using a conventional locking mechanism known to those skilled in the art and including movable locking key members 82. The shear disk assembly 80 includes a frangible closure member or shear disk 84 disposed in a tubular support member 86 and retained therein by suitable shear keys or pins 88. At a predetermined pressure acting on the shear disk 84 within the space 17, the pins 88 will fail and the disk 84 will be displaced to the alternate position shown to allow fluid to flow out of the member 86 through suitable ports 87.

In preparation for a fracturing operation to be carried out by the method of the invention, suitable fracturing liquid may be introduced into the space 20 and the tubing string 16 up to the predetermined level 40 so that a sufficient quantity of fluid is available to initiate and/or extend the fracture into the zone 13 a desired amount. With the wells 10 and 50 in communication with each other as illustrated, and the plug 58 disposed in the tubing string 54, pressure gas may be introduced into the spaces 55 and 17 by way of the compressor 70 or, if sufficient volume is available in the tubing strings 16 and 54, gas at ambient surface pressure may be allowed to flow into the spaces 55 and 17. Thereafter, the pressure of the gas in the spaces 55 and 17 may be built up by introducing liquid into the tubing string 54 by way of the pump 72 to compress the gas up to a predetermined pressure as measured by a suitable pressure gauge 61. The closure valves shown in FIG. 1 are, of course, placed in their appropriate operative positions to enable the method described herein to be executed.

Once the pressure in the conduits 16 and 54 has been raised to a predetermined value, the perforating gun 44 may be activated to form the perforations 32 in the casing 14. The liquid, under substantial gas drive pressure present in the conduits 54 and 16 will then be driven forcibly into the formation zone 13 to provide a suitable fracture extending either radially or having the desired radius of curvature as discussed in U.S. Pat. No. 5,074,359 to Joseph H. Schmidt and assigned to the assignee of the present invention.

Alternatively, if the perforations 32 are already formed, the shear disk assembly 80 may be disposed in the landing nipple 34 with, of course, the perforating gun 28 and electric line 30 removed from the tubing string 16 and the wellbore space 20. A suitable quantity of fracture fluid is disposed in the tubing string 16 and in the space 20 before placement of the shear disk assembly 80 in the landing nipple 34. Gas pressure is then built up in the tubing string 16 and the tubing string 54 in a manner generally as described above until the pressure exceeds that which will cause the shear disk 84 to be displaced to the alternate position shown in FIG. 2 to allow fracture fluid to flow through the ports 87 into the space 20 and into the formation zone of interest 13.

Accordingly, by placing a well such as the well 50 in communication with the tubing string 16 and by building up gas pressure in the tubing string 54 and the tubing string 16, a substantial "gas accumulator" effect is provided by the well 50 so that a sufficient volume of fracturing fluid is propelled into the formation zone of interest 13 to provide a suitable fracture. In this way, not only is a fracture formed and extended without substantial fluid pressure losses, which would be incurred in conventional fracturing operations where the fracture fluid is pumped from the surface through the entire length of the tubing string 16, but a substantial amount of gas accumulator volume is provided by the tubing string 54. Moreover, the tubing string 54 is disposed substantially below the earth's surface, is protected by a casing such as the casing 51 and the pressure differential across the tubing string 54 may be minimized by predisposing pressure fluid in the annulus 62.

Those skilled in the art will appreciate that substantially all of the casing 51 may be disposed below the earth's surface or extending below the water surface if the well is in a marine environment. The well 50 provides a readily available accumulator without requiring the use of pressure vessels having the strength to withstand high fluid pressures and placed in proximity to and in communication with the tubing string 16. In this way the hazards associated with high-pressure gas operations are minimized by using the gas accumulator space of an existing well and a tubing string disposed therein of suitable strength.

Although preferred embodiments of the invention have been described in detail herein, those skilled in the art will recognize that various substitutions and modifications may be made to the methods described without departing from the scope and spirit of the invention as defined by the appended claims.

What is claimed is:

1. A method for forming a fracture in an earth formation having a first wellbore extending therewithin, said first wellbore including a space defined in part by a first tubing string extending within said first wellbore, said first tubing string being operably connected to a wellhead, said method comprising the steps of:

providing said space at least partially filled with a fracturing liquid;

placing said space in communication with an accumulator space formed in a second wellbore;

introducing pressure gas into said space and said accumulator space; and increasing the pressure of said gas a predetermined amount sufficient to force liquid into said formation from said space at a pressure which exceeds the fracture breakdown pressure of said formation.

2. The method set forth in claim 1 wherein:

the step of increasing the pressure of said gas is carried out at least in part by introducing liquid into said accumulator space to compress gas in said accumulator space.

3. The method set forth in claim 1 wherein:

said accumulator space is provided by a second tubing string extending within said second wellbore.

4. The method set forth in claim 3 wherein:

said second tubing string includes closure means disposed therein to prevent pressure gas from exiting said accumulator space into said second wellbore.

5. The method set forth in claim 1 including the step of:

filling an annulus between said first wellbore and said first tubing string with pressure fluid to reduce the differential pressure acting across said first tubing string during the step of increasing the pressure of said gas in said space.

6. The method set forth in claim 4 including the step of:

filling an annulus between said second tubing string and said second wellbore with pressure fluid to reduce the differential pressure acting across said second tubing string.

7. A method of extending a hydraulic fracture into a zone of interest in an earth formation having a first well extending therein, said first well including a wellhead, a first tubing string extending from said wellhead within said first well, said method comprising the steps of:

placing frangible means in said first tubing string at a predetermined point to block the flow of fluid from said first tubing string to said earth formation;

placing said first tubing string in fluid flow communication with a second tubing string disposed in a second well;

placing a quantity of fracturing fluid in said first tubing string of said first well;

introducing pressure gas into at least said second tubing string in said second well and increasing the pressure of said gas to place said liquid in said first tubing string under a predetermined pressure which is sufficient to cause said frangible means to place said first tubing string in said first well in fluid flow communication with said formation to extend a hydraulic fracture therewithin.

8. The method set forth in claim 7 wherein:

the step of increasing the pressure of said gas is carried out by pumping liquid into said second tubing string to displace gas in at least a portion of said second tubing string.

9. A method of extending a hydraulic fracture into a zone of interest in an earth formation having a first well extending therein, said first well including a wellhead, a casing extending into said zone of interest and a first tubing string extending from said wellhead within said casing, said method comprising the steps of:

placing perforation forming means in said casing at a predetermined point;

placing said first tubing string in fluid flow communication with a second tubing string disposed in a second well;

placing a quantity of fracturing fluid in said first tubing string of said first well;

introducing pressure gas into at least said second tubing string in said second well and increasing the pressure of said gas to place said fluid in said first tubing string under a predetermined pressure; and actuating said perforation forming means to perforate said casing and place said first tubing string in said first well in fluid flow communication with said formation in said zone of interest to extend a hydraulic fracture therewithin.

10. The method set forth in claim 9 wherein:

the step of increasing the pressure of said gas is carried out by pumping liquid into said second tubing string to displace gas in at least a portion of said second tubing string.

* * * * *